US005137182A

United States Patent [19]

Keller

[11] Patent Number: 5,137,182

[45] Date of Patent: Aug. 11, 1992

[54] END CLOSURE FOR THE NOZZLE ORIFICE OF A DISPENSING CARTRIDGE

[75] Inventor: Wilhelm A. Keller, Grundstrasse 12, CH-6343 Rotkreuz, Switzerland

[73] Assignee: Wilhelm A. Keller, Rotkreuz, Switzerland

[21] Appl. No.: 606,496

[22] Filed: Oct. 31, 1990

[30] Foreign Application Priority Data

Dec. 4, 1989 [CH] Switzerland ..... 04328/89

[51] Int. Cl.[5] ..... B67B 5/00

[52] U.S. Cl. ..... 222/153; 222/485; 222/563; 222/575

[58] Field of Search ..... 222/94, 135, 136, 137, 222/145, 546, 562, 563, 153, 129, 575, 484, 485; 215/6, 356

[56] References Cited

U.S. PATENT DOCUMENTS

| | | | |
|---|---|---|---|
| 3,143,255 | 8/1964 | Leeds | 222/563 |
| 3,215,298 | 11/1965 | Shaffer . | |
| 3,351,242 | 11/1967 | Lodding et al. | 222/485 X |
| 3,506,157 | 4/1970 | Dukess | 222/563 |
| 3,773,227 | 11/1973 | Laing et al. | 222/153 |
| 3,828,980 | 8/1974 | Creighton et al. | 222/137 |
| 3,858,760 | 1/1975 | Goncalves et al. | 222/153 |
| 3,863,814 | 2/1975 | Shelton | 222/153 |
| 4,974,756 | 12/1990 | Pearson et al. | 222/94 |

FOREIGN PATENT DOCUMENTS

| | | |
|---|---|---|
| 0261466 | 11/1990 | European Pat. Off. . |
| 2017292 | 10/1971 | Fed. Rep. of Germany . |
| 1170639 | 1/1959 | France . |

*Primary Examiner*—Michael S. Huppert
*Assistant Examiner*—Gregory L. Huson
*Attorney, Agent, or Firm*—McAulay Fisher Nissen Goldberg & Kiel

[57] ABSTRACT

The end closure for the nozzle orifice of a dispensing cartridge for a two-component or multi-component system has at least two parallel stoppers which project from a common base and fit into the adjacent dispensing canals in the nozzle tube of the cartridge. For securing the closure to the cartridge in an axial direction, anchoring devices are provided to engage in the cartridge, such as lugs that permit elastic deformation, fitted with hooks or holding cams. At the junction with the base, each stopper has a continuous peripheral fillet. This acts conjointly with the edge of the orifice of the corresponding dispensing channel. The closure forms a secure seal for long-term storage and transport of the cartridge, is easy to use and inexpensive to make.

13 Claims, 2 Drawing Sheets

END CLOSURE FOR THE NOZZLE ORIFICE OF A DISPENSING CARTRIDGE

BACKGROUND OF THE INVENTION

1. Field of the Invention

The invention relates to an end closure for the nozzle orifice of a dispensing cartridge for multi-component systems, the end closure having at least two parallel stoppers that project from a common base and fit into the adjacent dispensing canals of the nozzle tube of the cartridge.

2. Prior art

An end closure of a similar kind is already known, for example from U.S. Patent Specification No. 3 828 980, which concerns a cartridge made with a sealed nozzle orifice that remains closed when the cartridge is being distributed and stored. The tip of the nozzle of the cartridge is cut off only to open the dispensing canals and enable the contents of the cartridge to be used. The simply designed end closure is used only to close the nozzle temporarily for a short time when the cartridge is partly empty. A further end closure of a similar type is known from European Patent Application published as number 0 261 466. When such a closure is used for a cartridge made with open dispensing canals, it has to be inserted immediately after the cartridge has been filled and must then close reliably and tightly during storage and transport of the cartridge until its contents are applied by the end user. To ensure that the closure does not become loose due to shock, compression of the cartridge's contents, temperature changes, etc, such as often occur during storage or transport, considerable pressure would have to be applied to fit its stoppers in the dispensing canals, but this would considerably complicate insertion of the closure and particularly its removal by the user. Further, because the cross-section of the dispensing canals is often not circular and sometimes has a number of corners, it is not easy to ensure an accurate fit between the cross-section of the canal and that of the stopper.

Instead of end closures with stoppers that project into the dispensing canals, cap closures without such stoppers are also used; these are made either as screw caps or for bayonet-type attachment. In these cases the seal is formed against the flat front face of the nozzle tube into which the dispensing canals discharge adjacent to each other. In the case of two-component or multi-component dispensing cartridges with two or more dispensing canals, the cap closure must contain an elastic sealing insert which the closure presses tightly against the nozzle orifice, because the sealing insert must reliably ensure that the separately stored component materials in the closely adjacent dispensing canals of the cartridge are prevented from coming into contact with each other when they reach the said sealing surface. When delivery pistons are being inserted in the filled cylinders of the cartridge, considerable pressure—which may vary from one cylinder to another may occur and be applied to the component materials, with the risk that component material may leak from one dispensing canal into another. Also, the manufacture and assembly of such sealing inserts cause additional costs, which are of some importance in such a cheap disposable component. Further, it is often difficult to find a material for use as a sealing insert that remains permanently elastic without fatigue but at the same time is equally resistant to all the component materials stored in the cartridge, some of which may be chemically reactive.

SUMMARY OF THE INVENTION

The present invention has as its principal object the design of an end closure of a type as initially described, which avoids all the problems referred to, meets all the stated requirements, is simple and cheap to make and easy to use.

The invention solves this problem by having anchoring devices connected to the common base, for axially securing the closure connected thereto, which engage in the cartridge, and by stoppers, each of which has a continuous peripheral fillet where it meets the base and which forms a tight seal against the edge of the nozzle of the dispensing canal. Such an end closure for a dispensing cartridge is simple and cheap to manufacture, preferably as a one-piece component, but embodiments made of two or more components are not excluded. Because the seal is formed primarily by pressure applied to the edges of the nozzles of the dispensing canals, there is no need for substantial pressure to be applied to the cross-section of the stoppers. This makes insertion and removal of the closure easy, and at the same time ensure that the anchoring devices engaging in the cartridge hold properly.

Preferred embodiments of the end closure for the nozzle orifice of a dispensing cartridge in accordance with the present invention are explained more specifically below in conjunction with the drawings.

DESCRIPTION OF THE DRAWINGS

In FIGS. 10 and 11, the outline of the cartridge is shown by dash-dotted lines.

DESCRIPTION OF THE INVENTION

Figure 1:
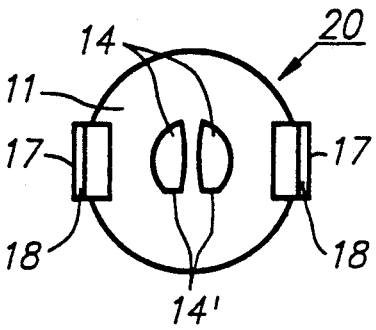
FIG. 1 is a front view of the stopper end of a first embodiment.
Figure 2:
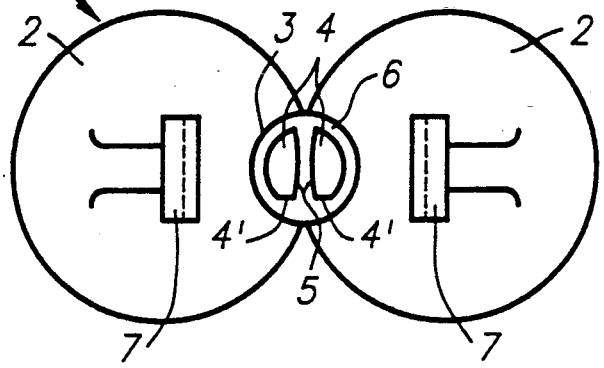
FIG. 2 is a front view of the cartridge and nozzle tube to be closed.
Figure 3:
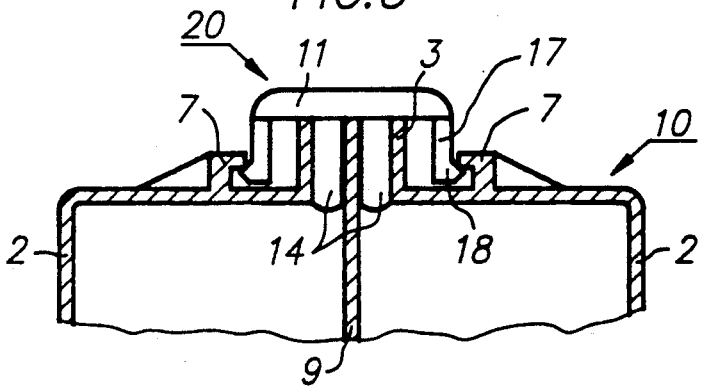
FIG. 3 is a longitudinal section of the cartridge shown in FIG. 2, showing the inserted end closure as shown in FIG. 1.

The end closure 20 shown in FIGS. 1 and 3 is designed to close the nozzle tube 3 of the dispensing cartridge 10 for two-component material shown in FIG. 2. The component materials of the two-component system, such as a resin and a hardener, are filled by the manufacturer into the storage cylinders 2 of the cartridge, where they are separately stored. The two storage cylinders 2 are separated by a partition wall 9. Each has a dispensing canal 4. The two dispensing canals 4 are side by side in the nozzle 3 and continue to the orifice 6. To close the canals 4, the end closure 20 has two parallel stoppers 14 that match the cross-sections of the canals 4. In systems having more than two component materials, the dispensing cartridge has the requisite number of storage cylinders 2 and dispensing canals 4, and the closure has the same number of stoppers 14 as there are dispensing canals 4 and orifices. Depending on whether the components are to be applied in the proportion 1:1 or some other proportion, the cylinders 2, the dispensing canals 4, and the cross-sections of the matching stoppers 14 may be identical or different. It is not unusual for the cross-section to have corners, for example as shown; in such cases, the stoppers 14 must have longitudinal edges. Such a type would make the use of O-rings practically impossible. The end closure 20 must ensure the proper closure of the dispensing canals in the nozzle from the moment the cartridge is filled, for the whole time the cartridge is stored and distributed, until the contents of the cartridge are used, and in particular it must also prevent contact between the different component materials in the nozzle region.

The stoppers 14 are parallel to each other and have a common base 11, which in the first embodiment as shown in FIGS. 1 to 3 forms a grip plate. Anchoring devices 17 are connected to the base 11. These are made to engage in counterwedges to the cartridge 10, in order to secure the inserted closure 20 axially. As shown in FIGS. 1 and 3, two lugs 17 approximately parallel to the stoppers 14 are formed on at the extremities of the grip plate 11 that forms the base. These lugs are slightly springy transversely to the stoppers 14 and have holding cams 18 at their ends. The anchoring devices 17 and holding cams 18 thus formed act together with the bayonet mount 7 formed on the end of the cartridge 10 on both sides of the nozzle tube 3. When the contents of the cartridge are being squeezed out through the dispensing canals 4 with the closure 20 removed, such a bayonet mount 7 is widely used to hold a dispensing nozzle, such as the tube of a static mixer that forms an extension to the nozzle tube 3.

To attach the end closure 20, the stoppers 14 are inserted axially in the dispensing canals 4; the holding cam 18 spring back against the lugs 17, slide over the bayonet mount 7, and finally engage at the back of its base. As a result, the underside of the grip plate 11 is held against the face 6 of the orifice tube 3. The stoppers 14 keep the canals 4 free from the component material stored in the cartridge. If the closure is already fitted in place before the cartridge is filled with component material, the stoppers 14 also prevent the inclusion of air that could otherwise be trapped in the nozzle canals 4. However, in long-term storage, the seal to the nozzle orifice is not formed primarily by a close fit of the stoppers 14 in the canals 4, but against the edge 5 of the orifice in each canal by the special means shown in detail in FIG. 4.

Figure 4:
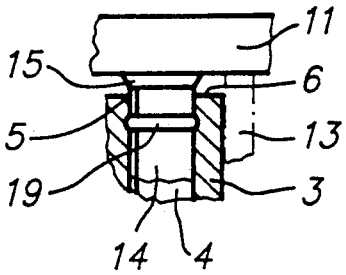
FIG. 4 is a detail at a larger scale showing a single stopper which has not yet been completely inserted in the dispensing canal.

FIG. 4 is a partial detail of a larger scale. This shows that each stopper 14 has a continuous peripheral fillet 15 where it joins the base 11. This fillet 15 lies tightly against the edge 5 of the orifice of the dispensing canal 4 when the end closure 20 is inserted, pressed fully home, and held securely in place by the counterwedges formed on the cartridge 10.

As shown in FIG. 4, the peripheral fillet 15 at the base of each stopper 14 can be formed as a conical profile, but other shapes, such as a radial fillet, are also feasible for the junction between the stopper 14 and the base 11. If the material used for the end closure 20 is harder than that used for the cartridge nozzle 3, the close fit of the peripheral fillet 15 slightly deforms the edge 5 of the orifice and ensures a tight seal; if the material of the end closure 20 is softer, the edge 5 of the orifice deforms the peripheral fillet 15 when the stopper is pressed in.

To provide an additional seal, a peripheral sealing collar 19 may also be provided, formed on the stopper 14 at some distance from the base 11, as shown in FIG. 4. Such a collar provides additional sealing by radial pressure against the inside of the wall of the dispensing canal 4.

Details of the peripheral fillet 15 and, where applicable, the additional sealing collar 19 described above are shown only in FIG. 4. They can apply to all stoppers 14 and all embodiments of the end closure described herein. In FIG. 4, a collar 13 projecting from the base 11 is indicated as a dash-dotted line; this is described below in conjunction with other typical embodiments of the invention. As shown in FIGS. 1 and 2, the cross-section of the stoppers 14 and the dispensing canals 4 may be asymmetrical, for example by having a flat surface 14′ or 4′ on one side. Such asymmetry prevents an accidental mismatch of the stoppers 14 and canals 4, for example by the end closure being turned through 180° relative to the orifices. This safety provision is useful when the end closure is used to reclose the orifice of a cartridge that has been partly emptied of its contents and prevents any part of the contents of the cartridge that may still adhere to the stoppers 14 from coming into contact with the other component material.

Figure 5:
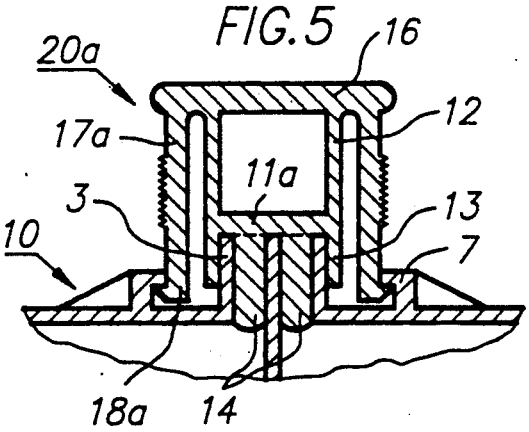
FIG. 5 is a longitudinal section showing a further embodiment, inserted in the nozzle of the cartridge.
Figure 6:
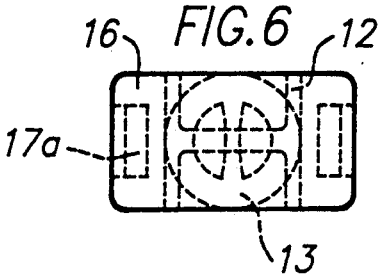
FIG. 6 is a view from above showing the end closure of FIG. 5.

In the embodiment of an end closure **20*a* shown in FIGS. 5 and 6, resilient lugs 17*a* connected to the base 11*a* again act as anchoring devices. The free ends of the lugs 17*a* have hooks 18*a* that engage at the back of the bayonet mount 7 on the cartridge 10. Because the lugs 17*a* form part of a cover plate 16 placed at some distance from the base 11*a*, they are longer than those of the embodiment shown in FIGS. 1 to 3. The closure shown in FIG. 5 and 6 is safe against accidental dislodgement from the cartridge 10, because, to remove the closure 20*a*, the lugs 17*a* have to be squeezed together by hand to disengage the hooks 18*a* from the base 7**.

As shown in FIG. 5, a cylindrical collar 13 projects from the base **11*a*, surrounds the stoppers 14, and overlaps the orifice tube 3. Such a collar affords additional protection to ensure that the closure forms a proper seal, for example if during transport of the cartridge lateral forces act on the closure 20*a*** which could otherwise push it askew.

Figure 7:
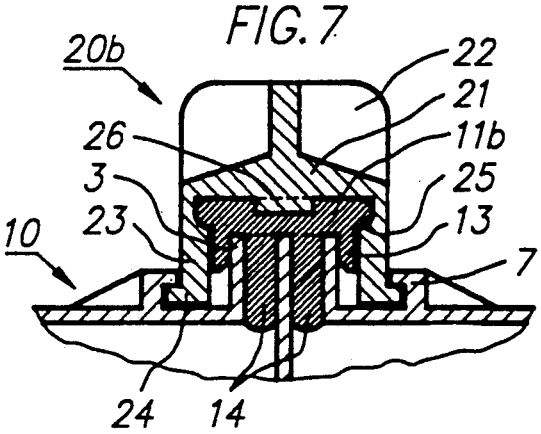
FIG. 7 is a longitudinal section showing a third embodiment, made in two parts, inserted in the nozzle of the cartridge.
Figure 8:
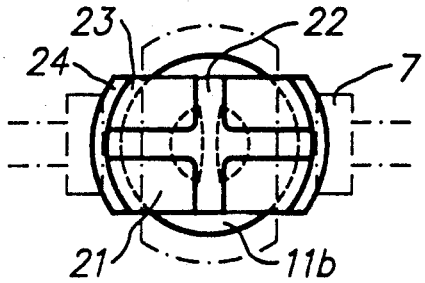
FIG. 8 is a view from above showing the embodiment of FIG. 7, with one part of the closure turned through 90° and parts of the cartridge shown by dash-dotted lines.

The embodiment of an end closure **20*b* shown in FIGS. 7 and 8 is designed in two parts. A first part has a base 11*b* from which project the stoppers 14 and a collar 13 surrounding the stoppers. The second part is designed as a locking piece 21 that overlaps the base 11*b* and can be rotated on this base as support. A central centering cam 26 fits into a central cavity formed in the base 11*b*. The locking piece 21 has a pair of diametrically opposed bayonet anchoring devices 23 with lugs 2 designed to engage at the back of the bayonet mount 7 on the cartridge 10. Gripper surfaces 22 allow the user to turn the locking piece 21. With the locking plate in the position shown by a dash-dotted line in FIG. 8, the stoppers 14 can be inserted axially in the dispenser canals; rotation of the locking piece through 90° causes the lugs 24 to engage at the back of the bayonet mount 7 to anchor the closure 20***b* securely to the cartridge 10. The upper face of the lugs 24 may be wedge-shaped to increase the axial pressure on the base 11*b*.

Figure 9:
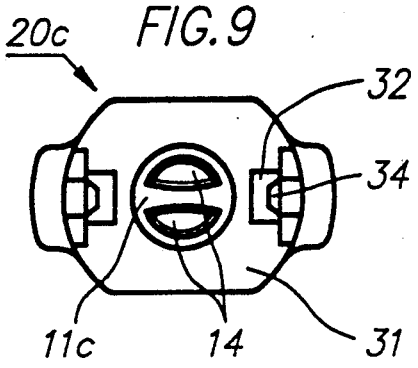
FIG. 9 is a front view of the stopper end of a fourth embodiment.
Figure 10:
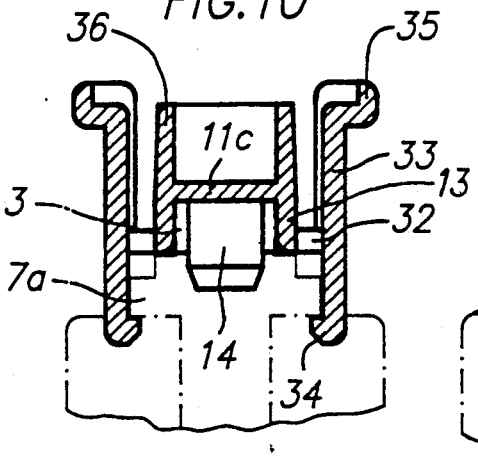
FIG. 10 is a longitudinal section through the end closure shown in FIG. 9.
Figure 11:
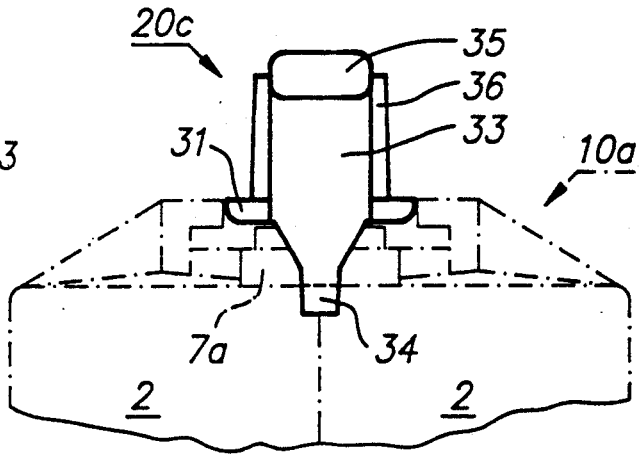
FIG. 11 is a side view to FIG. 10.

The embodiment of an end closure shown in FIGS. 9, 10, and 11 is again made as a one-piece device. It has two lugs 33 which are approximately parallel to the stoppers 14. At one of its ends, each lug 33 has a hook 34, at the other end it has a grip cam 35. In its middle section, each lug is connected as a springy element to the lower edge of a plate 31 which forms part of a collar 13 projecting from the base 11*c*. The cartridge 10*a* for which the closure 20*c* is intended has a front plate 7*a* connecting the front of the cartridge cylinders 2 and projecting on both sides of the orifice tube 3, as shown in FIG. 10. With the end closure 20*c* inserted, the hooks 34 grip the back of the face plate 7*a* to secure the closure axially. To open the closure, the user squeezes the two grip cams 35 to the lugs together by hand, releases the hooks 34, and pulls off the closure. Perforations 32 in the plate 31 allow the edge of the plate 31 connected to the lugs 33 to be deformed with less effort when the user squeezes the lugs 33 together. A stop 36 projecting up from the base 11*c* prevents the grip cams 35 being squeezed too close together.

While the foregoing description and drawings represent the preferred embodiments of the present invention, it will be obvious to those skilled in the art that various changes and modifications may be made therein without departing from the true spirit and scope of the present invention.

I claim:

1. End closure for the nozzle orifice of a dispensing cartridge for multi-component systems comprising: a common base; at least two parallel stoppers which project from said common base and fit into adjacent dispensing canals having respective orifices in a nozzle tube of a cartridge; anchoring devices being connected to the base and designed to engage in the cartridge to secure the closure in an axial direction, wherein each stopper has a peripheral fillet at its junction with said base for closing tightly against the edges of a respective orifice of said dispensing canals.

2. End closure in accordance with claim 1, said anchoring devices being formed to engage with bayonet mounts formed on the cartridge on both sides of the nozzle tube.

3. End closure in accordance with claim 1, said anchoring devices being formed to engage with the back of a face plate formed on the cartridge.

4. End closure in accordance with claim 1, having a pair of lugs connected approximately parallel with the stoppers and resiliently yielding transversely to the stoppers, free ends of said lugs being formed as holding cams or hooks.

5. End closure in accordance with claim 4, wherein a grip plate is affixed to said base, extremities of said grip plate having the lugs integrally attached.

6. End closure in accordance with claim 4, having hooked ends on the lugs which, when engaged, can be released by hand.

7. End closure in accordance with claim 6, having lugs, each of which being formed with a hook at one end and a grip cam at the other, and said lugs being connected to said base at about a mid-point between the ends of the lug by a springy connection so that pressure on the hook ends will release said grip cams.

8. End closure in accordance with claim 2, having a locking piece rotatably guided on the base and provided with a pair of diametrically opposed bayonet anchors.

9. End closure in accordance with any one of the aforegoing claims, wherein said sealing fillet at the junction of the stoppers with the base forms a conical slope or a radius with said function.

10. End closure in accordance with claim 1, having a peripheral sealing collar formed on each stopper at a distance from the base.

11. End closure in accordance with claim 1, having a collar surrounding the stoppers and projecting from the base, designed to overlap the nozzle tube.

12. End closure in accordance with claim 1, having stoppers of asymmetrical cross-section to match that of the dispensing canals.

13. End closure in accordance with claim 1, wherein the cross-section of the stoppers is non-circular and has one or more corners to match the cross-section of the dispensing canals.

* * * * *